United States Patent [19]

Brown

[11] 4,308,644

[45] Jan. 5, 1982

[54] SEALING ZIPPER

[76] Inventor: Alexander M. Brown, 53 Twin Coach Ct., Daytona Beach, Fla. 32014

[21] Appl. No.: 969,304

[22] Filed: Dec. 14, 1978

[51] Int. Cl.[3] ..... A44B 19/32

[52] U.S. Cl. ..... 24/205.1 R

[58] Field of Search ..... 24/205.1 R, 205.1 C, 24/205 R, 205.13 R, 205.15 R

[56] References Cited

U.S. PATENT DOCUMENTS

| | | | |
|---|---|---|---|
| 2,385,816 | 10/1945 | Krupp | 24/205.15 R X |
| 2,873,741 | 2/1959 | Donaldson | 24/205.1 R X |
| 3,026,589 | 3/1962 | Sperry et al. | 24/205.1 R |
| 3,082,501 | 3/1963 | Brown | 24/205.1 R |
| 3,668,745 | 6/1972 | Krupp | 24/205.1 |
| 3,711,903 | 1/1973 | Brown | 24/205.1 R |
| 3,854,175 | 12/1974 | Yoshida | 24/205.1 R |
| 3,859,150 | 1/1975 | Van Amburg | 24/205 R X |
| 3,892,016 | 7/1975 | Brown | 24/205.1 R |

*Primary Examiner*—Philip C. Kannan

[57] ABSTRACT

A pressure sealing zipper comprising a gasket assembled to an interdigitating zipper chain which uses a slider without a diamond to penetrate between the interlocking portions of the elements. On one side of the zipper chain, a single plate slider tracks in slots adjacent the zipper tape and maintains the elements in coplanar relationship by contacting the elements both directly and indirectly through the zipper tape. The sealing gasket is carried by the elements on the side opposite the slider. This construction permits the slider to terminate above the gasket opening in a closed end sealing zipper.

13 Claims, 9 Drawing Figures

SEALING ZIPPER

BACKGROUND OF THE PRESENT INVENTION

1. Field of the Invention

This invention relates to sealing zippers and particularly to the type which must seal uniformly from one closed end through the other closed end.

2. Description of the Prior Art

In known attempts to construct sealing zippers of the interdigitating type, it has been necessary to attempt to seal around the slider diamond which connects the front and back plates of the slider and must, necessarily, penetrate between the zipper elements and through the zipper chain. This sealing around the slider diamond at the terminal position has never been satisfactorily accomplished in production and presently known sealing zippers are undependable in operation and very costly in manufacture and application.

SUMMARY OF THE INVENTION

The present invention comprehends the use of an interdigitating zipper chain with elements adapted to track a slider which has no diamond penetrating between the interlocking portions of the elements. A slider with only one plate tracks in slots on one side of the chain and contacts the elements directly on the slider side of the chain and/or indirectly through the zipper tape to the other side of the chain. This retains the elements in their coplanar relationship for alignment during interlocking as is accomplished conventionally by a slider with both front and back plates connected by a diamond.

The sealing gasket is attached either mechanically or by bonding to the side of the zipper chain opposite the slider.

Since the slider has no diamond penetrating between the elements, the angle of interlocking, and the separation between the elements when open, can be minimal. On a closed top end zipper, this reduces the separation between the elements in the interlocking action and permits the slider to travel above the opening in the gasket thereby eliminating the need to seal around the slider diamond at the terminal location.

The sealing gasket is preferably molded, extruded or fabricated as a complete unit which can be slit for the length of the desired opening before or after assembly with the zipper chain. Since the gasket need not be slit at either the top or bottom, it is no longer necessary to bond or mold the two opposite parts together as in known constructions.

DETAILED DESCRIPTION OF THE PREFERRED EMBODIMENT

Figure 1:
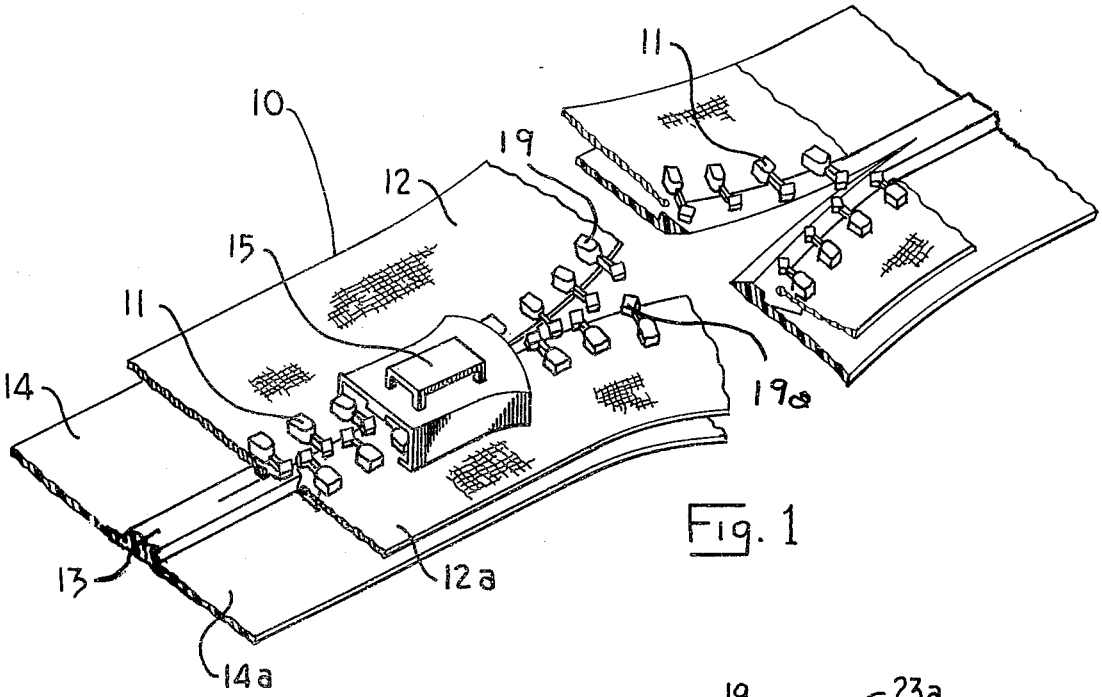
FIG. 1 is a fragmentary perspective view of a sealing zipper incorporating the invention.
Figure 2:
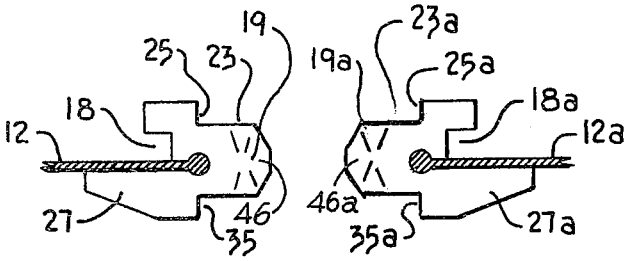
FIG. 2 is an end view of two opposing elements in the separated position.
Figure 3:
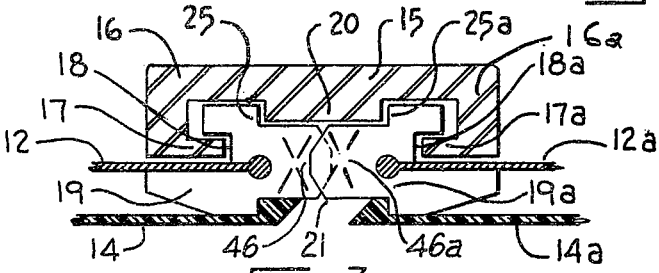
FIG. 3 is a sectional view of a sealing zipper showing the slider, the chain, and the gasket when separated.

In the exemplary embodiment of the invention as shown in FIG. 1, a closed top end zipper generally designated 10 is shown to comprise an interdigitating zipper chain 11 with tapes 12 and 12*a* and a sealing gasket 13 with impermeable tapes 14 and 14*a*. Referring to FIG. 2, elements 19 and 19*a* have slots 18 and 18*a* adjacent the tapes 12 and 12*a*. A single plate slider 15, shown in cross section with the elements in open position in FIG. 3, has downwardly depending flanges 16 and 16*a* which carry reverse flanges 17 and 17*a* tracking in slots 18 and 18*a* in elements 19 and 19*a*.

The zipper chain 11 is composed of two interlocking halves having elements 19 and 19*a* die cast, molded or otherwise formed and attached to zipper tapes 12 and 12*a*. These tapes can be of conventional fabric or the like and the elements 19 and 19*a* can be of metal, polymer or any conventional material. The interlocking portion 46 and 46*a* of each element 19 and 19*a* can be conventional and of any design although a type requiring a minimum of angle at interlocking would be preferable.

Figure 4:
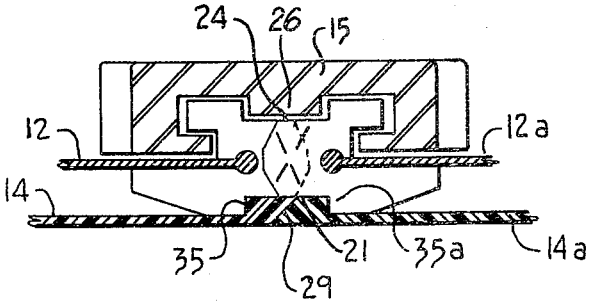
FIG. 4 is the view of FIG. 3 but with the elements interlocked.
Figure 5:
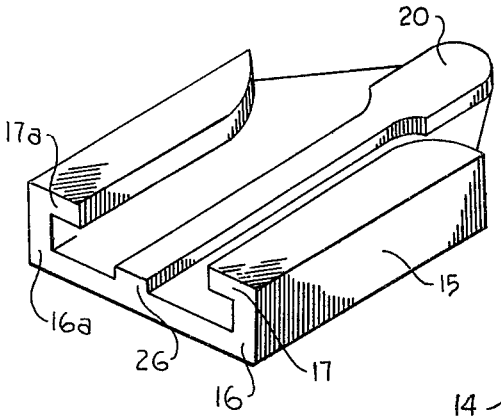
FIG. 5 is an enlarged perspective view of the underside of the slider.

Each element 19 and 19*a*, see FIG. 2, can have a recess 23 and 23*a* with walls 25 and 25*a* forming a channel 24 when the chain is closed, as in FIG. 4. The slider 15, see enlarged view FIG. 5, can have a depending flange 26 which travels in channel 24 and serves to align the elements 19 and 19*a* in a common plane for interlocking. Depending flange 26 has a wider portion 20 which separates the elements 19 and 19*a* by pressure on the walls 25 and 25*a* when opening, see FIG. 3. No part of slider 15 penetrates between the interlocking portions 46 and 46*a* of elements 19 and 19*a*.

To assist in the aligning of the elements 19 and 19*a* when interlocking, or as an alternate construction, see FIG. 2, each element 19 and 19*a* has an extended leg 27 and 27*a* on the side of the element opposite the slider 15. The leg extensions 27 and 27*a*, see FIG. 3, contact the reverse flanges 17 and 17*a* of the slider 15 through the tapes 12 and 12*a* so that the elements 19 and 19*a* are held in coplanar alignment despite any lateral strain as long as the reverse flanges 17 and 17*a* remain in slots 18 and 18*a*.

Each element 19 and 19*a* also has a gasket retaining ledge 35 and 35*a*, see FIG. 2, forming a channel 21 between them when the chain 11 is closed, as in FIG. 4.

Figure 7:
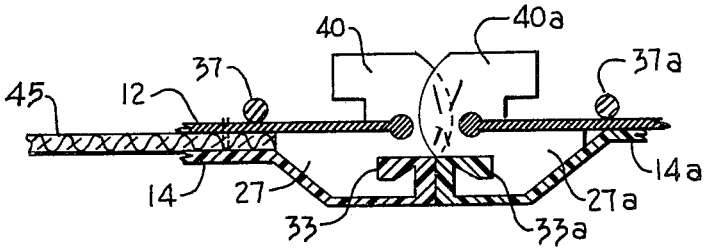
FIG. 7 is a modified construction showing an end view of an alternate element with mechanical means for attaching the sealing gasket.

In a modified construction, see FIG. 7, the elements 40 and 40*a* with the extended legs 27 and 27*a* do not need the recesses 23 and 23*a* since the extended legs 27 and 27*a* will maintain the elements in coplanar relationship by pressure on the reverse flanges of the slider, not shown, during interlocking. In this case, cords or projections 37 and 37*a* are attached to tapes 12 and 12*a* by sewing or otherwise and so positioned that the wider outside portion of the slider separates the cords as it passes between them and so separates the elements 40 and 40*a*.

A zipper chain so constructed will operate in a manner similar to that of any known interdigitating zipper chain but will not require a slider diamond to penetrate between the interlocking portions of the elements and so cause undue separation of the halves of the zipper as is the case in presently known zippers. Eliminating the need for a slider diamond is an advantage when sealing the top end of a closed end sealing zipper as will be explained subsequently.

Figure 6:
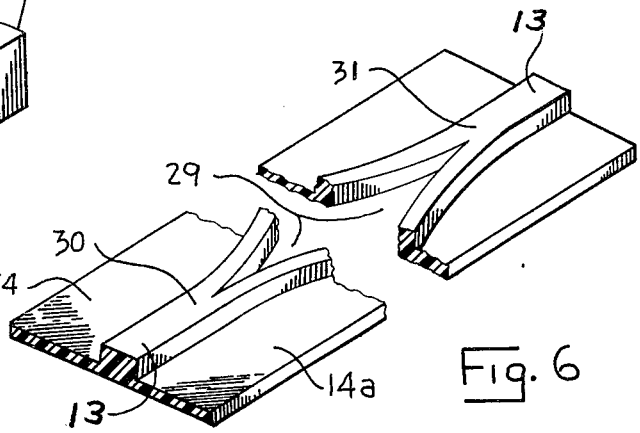
FIG. 6 is a perspective view of the sealing gasket after slitting.

The gasket 13, see FIG. 6, is molded, extruded or fabricated of the proper material to meet the requirements of the application, whether it is to be sealing against liquid, gas, toxic or dangerous atmospheres, thermal extremes, etc. The gasket 13 can be made as a solid unit with two integral impermeable tapes 14 and 14*a*, then slit, as at 29, either before or after assembly with the chain 11 for the length that the sealing zipper is desired to open. The slit opening 29 can be either perpendicular to the plane of the chain 11 or at an angle to it. Slitting the gasket at an angle aids in preventing leakage when the zipper chain is flexed.

As shown in FIG. 6, the ends 30 and 31 of the gasket 13 can be left unslit so there is no need to bond them together at assembly as in known constructions. Gasket 13 is preferably of a width greater than the width of channel 21 between the ledges 35 and 35*a* so that the gasket 13 is under slight compression when the chain 11 is closed.

Figure 8:
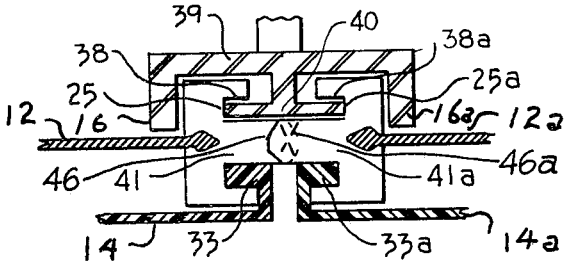
FIG. 8 is a modified construction in the open position showing alternate slots to track the slider.
Figure 9:
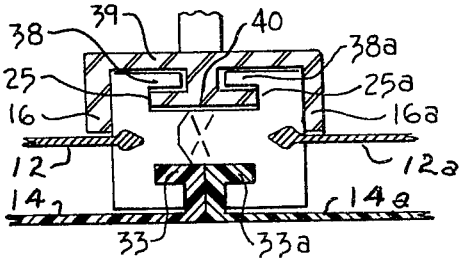
FIG. 9 is the same construction as shown in FIG. 8 but in the closed position.

Since both chain 11 and gasket 13 can be produced in continuous lengths, they can be assembled in a continuous process by bonding, induction welding, molding or any conventional process. If this is not feasible due to the gasket material or for any other reason, the gasket retaining ledges 35 and 35*a* can be modified as shown in FIGS. 7, 8 and 9, to form L-shaped openings 33 and 33*a* which retain the gasket by friction or conventional bonding as shown in FIGS. 8 and 9 or by mechanical swaging or heating as shown in FIG. 7. With the gasket enclosed in the L-shaped openings 33 and 33*a*, sealing is equally effective from both sides regardless of flexing of the zipper chain. The gasket is also protected from damage and from leakage caused by distortion due to mechanical pressure on the zipper chain.

In presently available sealing zippers, the most difficult area to seal is at the top end of a closed end sealing zipper where it is necessary to seal around the slider diamond which penetrates between the interlocking elements at the terminal location. In this invention, with the inherent advantages of minimal separation of the elements and a slider with no diamond, it is possible for the slider 15 to travel above the slit 29 in the gasket 13, to a terminal position where the gasket 13 is unslit as at 31, see FIG. 6, and where no sealing around the slider diamond is necessary. If necessary with certain gaskets, the elements can be modified or other changes can be made to permit the slider to travel above the slit opening in the gasket.

As shown in FIG. 7, if the gasket tape 14*a* is attached to the zipper tape 12*a* in manufacture, both can be sewn into the application conventionally, if tapes 12 and 14 are left unattached, zipper tape 12 can be sewn into the application 45 conventionally and gasket tape 14 bonded over the stitching to seal it.

FIGS. 8 and 9 show a modification of this invention in which the elements 41 and 41*a* have the walls 25 and 25*a* extended into L-shaped slots 38 and 38*a* which track a modified slider 39. This slider does not have the reverse flanges 17 and 17*a* to travel in slots 18 and 18*a* in the elements but does have a T-shaped depending flange 40 which travels in the L-shaped slots 38 and 38*a* to prevent the slider from leaving the chain and to retain the elements in interlocking alignment while, as shown in FIG. 9, flanges 16 and 16*a* force the elements into interlocking relationship. The T-shaped portion of depending flange 40 widens, see FIG. 5, to separate the elements when the slider is moved in the opposite direction as shown in FIG. 8.

Obviously, the slider tracking slots can be rounded rather than square as shown, or the tape adjacent the slots can be coated with metal or plastic, etc. to reduce friction when contacting the reverse flange of the slider. Also, the zipper and gasket tapes could be combined as one in certain designs without departing from the spirit of the invention.

It will also be obvious to anyone skilled in the art that a sealing zipper as shown could be used on applications in which only one end need be sealed. While this invention answers the problems of producing a practical pressure sealing zipper, closed at both ends, the advantages of different gasket materials, dependable operation, etc. show that its use on other than closed top end zippers would be advantageous.

It will also be obvious that such a sealing zipper gasket could be used simply to hide or conceal a zipper chain in applications where this is an advantage. This invention makes possible a practical, low cost, closed end sealing zipper superior to any similar product now available.

I claim:

1. A sealing zipper comprising a separable interdigitating chain composed of two interlocking halves having elements attached to flexible tapes and interlocked by a slider moving in one direction along said chain and separated by moving said slider in the opposite direction, said chain carrying a separable, impermeable gasket on one side, wherein the improvement comprises:

said slider being of single plate construction and having dependent flanges which engage said elements on the side opposite said gasket but do not penetrate between the interlocking portions of said elements, two of said depending flanges extending outwardly of said elements to force them together and one of said depending flanges extending downwardly sufficiently to engage upwardly projecting walls on said elements to retain said elements in co-planar relationship during interlocking.

2. The sealing zipper of claim 1 wherein the said zipper tapes are sewn into an application and the tapes of said gasket are bonded over the stitching of the said zipper tapes.

3. The sealing zipper of claim 1 wherein said gasket is slit only for a distance which is less than the length of the interlocked chain when the slider is at the closed terminal position.

4. The sealing zipper of claim 1 wherein a central depending flange of said slider contacts opposing walls on each element which are substantially 90° to the plane of said chain to align said elements during interlocking.

5. The sealing zipper of claim 4 wherein said walls contacting the said central depending flange are located adjacent the interlocking portion of each said element.

6. The sealing zipper of claim 4 wherein said central depending flange has a wider portion contacting said opposing walls on said elements to separate said elements when said slider is moved to open the said chain.

7. The sealing zipper of claim 1 wherein each said element carries a ledge on the side opposite said slider at substantially 90° to the plane of said chain forming a gasket supporting channel therebetween when the said elements are interlocked.

8. The sealing zipper of claim 7 wherein said ledge is extended to comprise a substantially L-shaped enclosure adapted to contain a part of said gasket.

9. The sealing zipper of claim 1 wherein said gasket is formed of resilient material as a single strip which is slit lengthwise for a distance which is less than the length of travel of the said slider.

10. The sealing zipper of claim 9 wherein the top and/or the bottom of the said gasket remains unslit.

11. The sealing zipper of claim 9 wherein said slider terminates on said chain above said slit in said gasket.

12. The sealing zipper of claim 1 wherein each of said elements has an extended leg on the side opposite the said slider and on the same side as the said separable, impermeable gasket.

13. A sealing zipper comprising a separable interdigitating chain composed of two interlocking halves having elements attached to flexible tapes and interlocked by a slider moving in one direction along said chain and separated by moving said slider in the opposite direction, said chain carrying a separable, impermeable gasket on one side, wherein the improvement comprises:

said slider being of single plate construction and having dependent flanges which engage said elements on the side opposite said gasket but do not penetrate between the interlocking portions of said elements, two of said depending flanges extending outwardly of said elements to force them together and each of said elements having an extended leg on the side opposite said slider which cooperates with said depending flanges to retain said elements in co-planar relationship during interlocking.

* * * * *